US009409218B2

(12) United States Patent
Baldwin et al.

(10) Patent No.: US 9,409,218 B2
(45) Date of Patent: Aug. 9, 2016

(54) EXTRUSION PIECE WITH DISSIMILAR ENDS

(71) Applicants: Michael J. Baldwin, Warwickshire (GB); Madan Gopal, Dublin, CA (US); Yih-Charng Deng, Mountain View, CA (US)

(72) Inventors: Michael J. Baldwin, Warwickshire (GB); Madan Gopal, Dublin, CA (US); Yih-Charng Deng, Mountain View, CA (US)

(73) Assignee: Tesla Motors, Inc., Palo Alto, CA (US)

( * ) Notice: Subject to any disclaimer, the term of this patent is extended or adjusted under 35 U.S.C. 154(b) by 475 days.

(21) Appl. No.: 13/874,959

(22) Filed: May 1, 2013

(65) Prior Publication Data

US 2014/0326351 A1 Nov. 6, 2014

(51) Int. Cl.

| | |
|---|---|
| ***B21D 26/033*** | (2011.01) |
| ***B21C 37/15*** | (2006.01) |
| ***B21C 35/02*** | (2006.01) |

(52) U.S. Cl.

CPC ..... *B21C 37/155* (2013.01); *B21C 35/023* (2013.01); *B21D 26/033* (2013.01)

(58) Field of Classification Search

CPC ... B21C 37/155; B21C 35/023; B21D 26/033
USPC ..... 296/203.01, 187.03; 138/109; 72/55
See application file for complete search history.

(56) References Cited

U.S. PATENT DOCUMENTS

| | | | | |
|---|---|---|---|---|
| 4,125,924 | A * | 11/1978 | Goetze et al. | 29/895.21 |
| 5,170,557 | A * | 12/1992 | Rigsby | 29/890.08 |
| 5,435,205 | A | 7/1995 | Seksaria et al. | |
| 5,557,961 | A | 9/1996 | Ni et al. | |
| 5,673,929 | A | 10/1997 | Alatalo | |
| 6,099,071 | A * | 8/2000 | Kasuga et al. | 296/205 |
| 6,450,565 | B2 * | 9/2002 | Yamamoto | 296/187.09 |
| 6,584,689 | B2 | 7/2003 | Bruggemann et al. | |
| 6,588,459 | B2 * | 7/2003 | O'Connell | 141/46 |
| 6,679,417 | B2 * | 1/2004 | Dziadosz et al. | 228/235.2 |
| 6,705,668 | B1 * | 3/2004 | Makita et al. | 296/187.03 |
| 7,178,240 | B2 | 2/2007 | Lo | |
| 7,488,022 | B2 * | 2/2009 | Belwafa et al. | 296/29 |
| 7,596,848 | B2 * | 10/2009 | Urech | B21C 37/154 29/508 |
| 2001/0030432 | A1 * | 10/2001 | Mansoor et al. | 293/120 |
| 2002/0125739 | A1 * | 9/2002 | Czaplicki et al. | 296/187 |
| 2011/0031779 | A1 * | 2/2011 | Uchida et al. | 296/187.03 |

OTHER PUBLICATIONS

A. Kocańda, H. Sadlowska, Automotive component development by means of hydroforming, 2008.

Manufacturing-Forming, The Aluminum Automotive Manual, pp. 1 and 69-90, 2002.

Processes for hydroforming sheet metal, Stamping Journal, 2006.

* cited by examiner

*Primary Examiner* — Pinel Romain

(74) *Attorney, Agent, or Firm* — Garlick & Markison; Bruce E. Garlick

(57) ABSTRACT

A method includes: determining a design for a longitudinal piece of a particular length, wherein first and second ends of the longitudinal piece have dissimilar shapes; extruding a piece that is at least twice the particular length, wherein a profile throughout the extruded piece has the first end shape; hydroforming the extruded piece to generate an expanded portion between ends of the extruded piece, wherein the ends retain essentially the first end shape; and cutting through the expanded portion to obtain a piece wherein one end has the first end shape and another end has the second end shape.

12 Claims, 3 Drawing Sheets

EXTRUSION PIECE WITH DISSIMILAR ENDS

BACKGROUND

Extruded aluminum pieces are used in various implementations, for example as structural vehicle components designed to absorb impact energy (e.g., in a crash). However, achieving a controlled collapse can be difficult, for example because the extrusion is usually prismatic in nature. Forming the piece by another technique than extrusion (e.g., by fabricating it from sheet metal) does not provide the material properties of extrusion.

SUMMARY

In a first aspect, a method includes: determining a design for a longitudinal piece of a particular length, wherein first and second ends of the longitudinal piece have dissimilar shapes; extruding a piece that is at least twice the particular length, wherein a profile throughout the extruded piece has the first end shape; hydroforming the extruded piece to generate an expanded portion between ends of the extruded piece, wherein the ends retain essentially the first end shape; and cutting through the expanded portion to obtain a piece wherein one end has the first end shape and another end has the second end shape.

Implementations can include any or all of the following features. The first end shape is chosen for the design to be a folded version of the second end shape. A perimeter of the first end shape is substantially the same as a perimeter of the second end shape. The first end shape comprises two rounded portions joined by a waist. The second end shape comprises an oval. Hydroforming the extruded piece comprises prestretching the other end having the second end shape. The piece is extruded from aluminum or an aluminum alloy.

In a second aspect, a longitudinal piece includes: a first end having a first end shape; and a second end a having a second end shape dissimilar from the first end shape, wherein the second end shape is obtained by cutting through an expanded portion generated by hydroforming an intermediate portion of an extruded piece that initially has a profile corresponding to the first end shape.

Implementations can include any or all of the following features. The first end shape is chosen for the design to be a folded version of the second end shape. A perimeter of the first end shape is substantially the same as a perimeter of the second end shape. The first end shape comprises two rounded portions joined by a waist. The second end shape comprises an oval. Hydroforming the extruded piece comprises prestretching the other end having the second end shape. The piece is extruded from aluminum or an aluminum alloy.

DETAILED DESCRIPTION

This document describes systems and techniques for using extrusion and hydroforming to create a piece that has a desired design and the material properties of an extrusion. For example, a piece can be extruded from aluminum to have a certain profile throughout its length, and this piece can then be placed in a hydroformer where the pressure causes a center section of the piece to bulge out. When removed from the hydroformer, the shaped piece can be cut apart (e.g., at the middle) so that the bulging section creates a desired end profile at one end of each of the pieces, wherein the other end has substantially the same profile as when extruded.

Figure 1A:
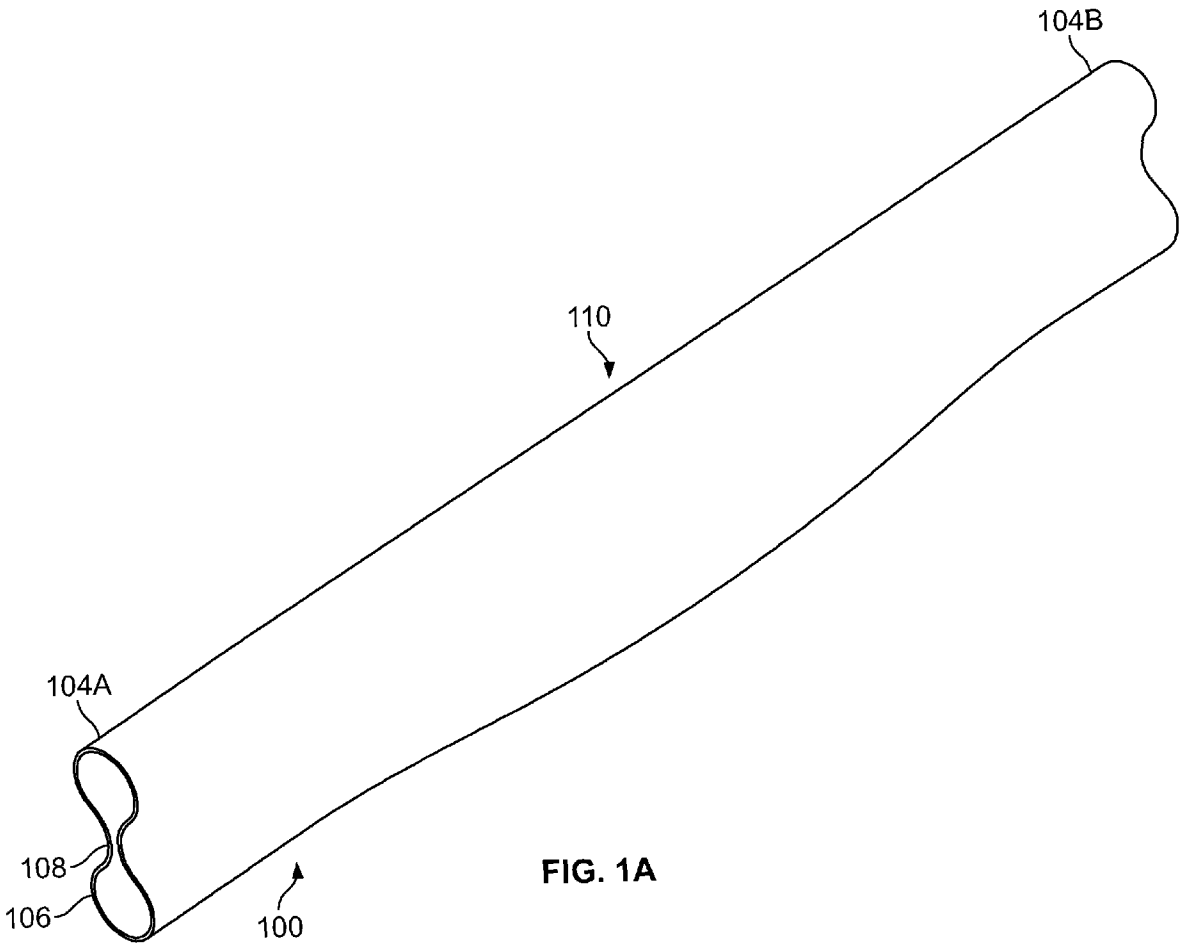
FIGS. 1A-B show an example of cutting apart a hydroformed piece to obtain a desired design.
Figure 1B:
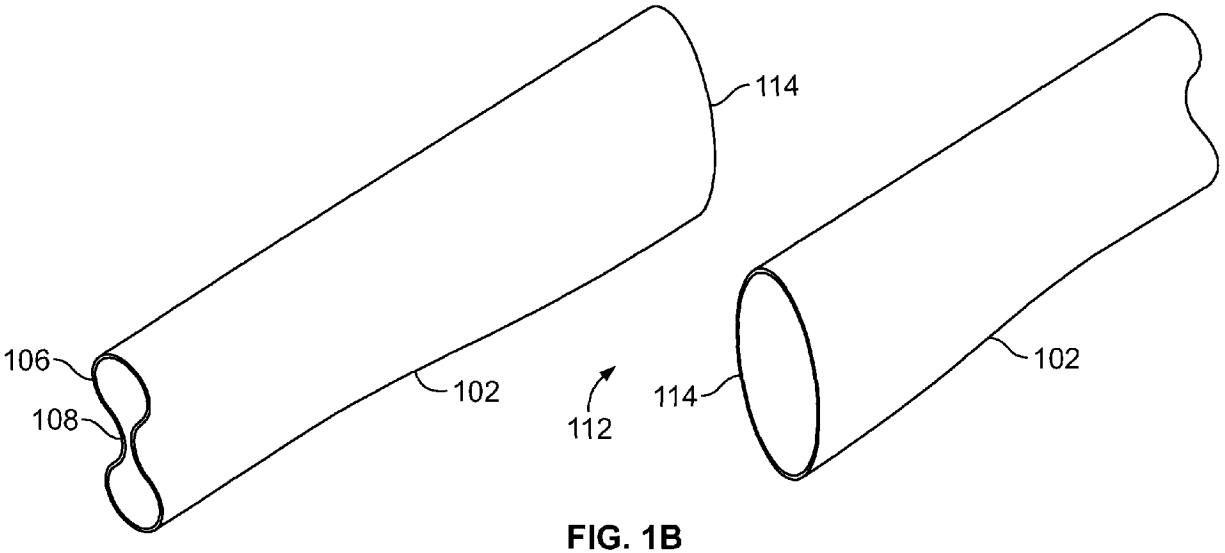

FIGS. 1A-B show an example of cutting apart a hydroformed piece 100 to obtain a desired design 102. The hydroformed piece has a first end 104A and a second end 104B. The first and second ends have essentially the same profile—that is, two rounded portions 106 joined by a waist 108. An example of how the piece 100 is created will be described below.

Here, a center portion 110 of the hydroformed piece 100 bulges out compared to the rest of the piece. Particularly, the center portion has a profile that is desirable as an end shape of a design. The hydroformed piece can therefore be cut apart—e.g., severed at the middle using a saw or other blade) to form respective pieces 112 as shown in FIG. 1B.

Each of the pieces 112 has the desired design 102. That is, each of the pieces 112 has a first end with the extruded profile (e.g., the rounded portions 106 joined by the waist 108) and a second end with a desired profile 114. In this example, the desired profile is essentially an oval shape. The oval can provide additional stability (e.g., during a process of controlled collapse, such as in a crash). In some implementations, each end of the piece 112 is mounted onto an end block that substantially corresponds to its shape. For example, the first end can attach to the front bumper of a vehicle and the second end can attach to a structure further back in the vehicle (e.g., a torque box).

Figure 2B:
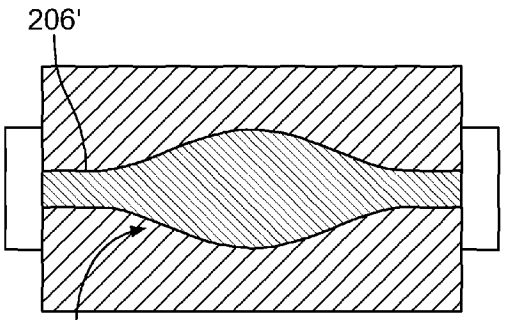
FIGS. 2A-B show an example of creating the hydroformed piece in FIG. 1.
Figure 2A:
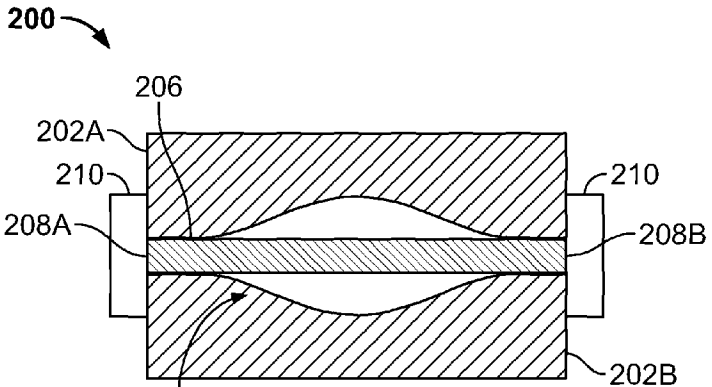

FIGS. 2A-B show an example of creating the hydroformed piece 100 in FIG. 1. The process involves a hydroformer 200 (shown in cross section) that in this example comprises a first half 202A and a second half 202B. When the two halves are mounted against each other, they form an internal cavity 204. The internal cavity is designed so that at least its midsection has the profile for the other end of the desired design. For example, the internal cavity can have an essentially oval cross section.

Here, an extrusion piece 206 is clamped in the hydroformer 200. That is, a first end 208A of the extrusion piece is clamped by one end of the hydroformer, the body of the extrusion piece extends through the internal cavity 204, and a second end 208B of the extrusion piece is clamped by another end of the hydroformer. Components 210 that enclose the ends of the extrusion piece indicate that the ends are sealed and that a liquid under pressure (e.g., water) can be injected into the extrusion piece.

Suppose now that liquid is injected into the extrusion piece using the component(s) 210. Assuming that the pressure is strong enough, the liquid will deform the extruded aluminum to some extent. FIG. 2B shows that a center section of the extrusion piece has expanded until it meets the surface of the internal cavity 204, thereby creating a hydroformed extrusion piece 206'. At this point, the pressurized liquid is drained from the piece and further processing can be performed. For example, the hydroformed extrusion piece can be cut apart—similar to the above example in FIGS. 1A-B of cutting apart piece 100 to form pieces 112.

Referring again to FIGS. 1A-B, in some implementations the extrusion profile (i.e., the rounded portions 106 joined by the waist 108) is selected as a folded or convoluted version of the desired profile 114. That is, the desired profile (e.g., an oval) may be larger than what can practically be extruded using an available extruder. Therefore, the profile of the rounded portions and waist can be created to have a certain perimeter, and when the desired profile is created by hydroforming, the resulting profile (e.g., an oval) may have substantially the same perimeter as before the hydroforming. That is, the hydroforming does not necessarily increase the total perimeter of the extrusion piece, but it does re-shape the extrusion profile into another (e.g., more desirable) design.

In the above examples, a hydroformed extrusion piece was described where a first end had a profile of two rounded portions joined by a waist, and the second end was essentially oval. In some implementations, one or more other shapes can be used for the first and/or second end. As another example, hydroforming can be performed using a suitable liquid other than water, including, but not limited to, oil.

Figure 3:
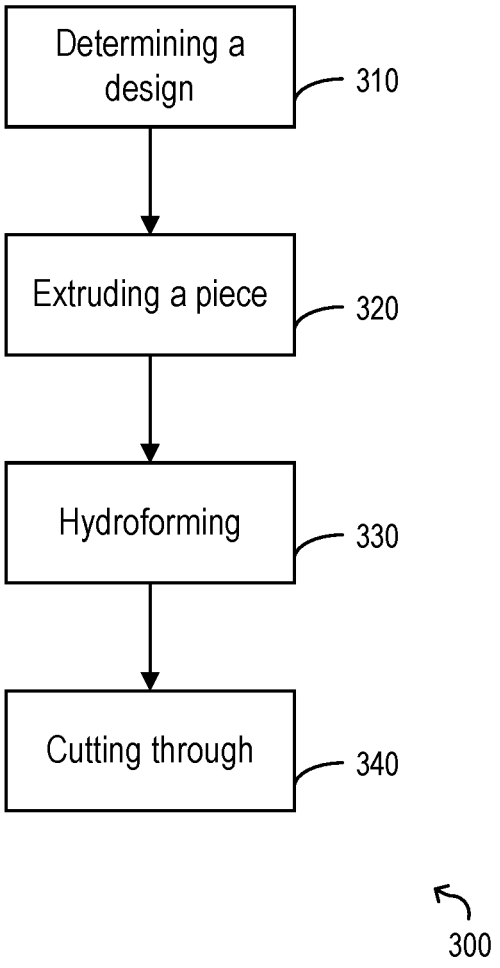
FIG. 3 shows a method.

In FIG. 3, a method 300 includes: determining (310) a design for a longitudinal piece of a particular length, wherein first and second ends of the longitudinal piece have dissimilar shapes; extruding (320) a piece that is at least twice the particular length, wherein a profile throughout the extruded piece has the first end shape; hydroforming (330) the extruded piece to generate an expanded portion between ends of the extruded piece, wherein the ends retain essentially the first end shape; and cutting (340) through the expanded portion to obtain a piece wherein one end has the first end shape and another end has the second end shape.

A number of implementations have been described as examples. Nevertheless, other implementations are covered by the following claims.

What is claimed is:

1. A method comprising:

determining a design for a longitudinal piece of a particular length, wherein first and second ends of the longitudinal piece have dissimilar shapes, wherein the first end shape is chosen for the design to be a folded version of the second end shape;

extruding a piece that is at least twice the particular length, wherein a profile throughout the extruded piece has the first end shape;

hydroforming the extruded piece to generate an expanded portion between ends of the extruded piece, wherein the ends retain essentially the first end shape; and cutting through the expanded portion to obtain a piece wherein one end has the first end shape and another end has the second end shape.

2. A method comprising:

determining a design for a longitudinal piece of a particular length, wherein first and second ends of the longitudinal piece have dissimilar shapes;

extruding a piece that is at least twice the particular length, wherein a profile throughout the extruded piece has the first end shape;

hydroforming the extruded piece to generate an expanded portion between ends of the extruded piece, wherein the ends retain essentially the first end shape; and cutting through the expanded portion to obtain a piece wherein one end has the first end shape and another end has the second end shape; wherein a perimeter of the first end shape is substantially the same as a perimeter of the second end shape.

3. The method of claim 1, wherein the first end shape comprises two rounded portions joined by a waist.

4. The method of claim 1, wherein the second end shape comprises an oval.

5. The method of claim 1, wherein hydroforming the extruded piece comprises pre-stretching the other end having the second end shape.

6. The method of claim 1, wherein the piece is extruded from aluminum or an aluminum alloy.

7. A longitudinal piece comprising:

a first end having a first end shape; and a second end a having a second end shape dissimilar from the first end shape, wherein the first end shape is chosen for the design to be a folded version of the second end shape, wherein the second end shape is obtained by cutting through an expanded portion generated by hydroforming an intermediate portion of an extruded piece that initially has a profile corresponding to the first end shape.

8. The longitudinal piece of claim 7, wherein a perimeter of the first end shape is substantially the same as a perimeter of the second end shape.

9. A longitudinal piece comprising:

a first end having a first end shape, wherein the first end shape comprises two rounded portions joined by a waist; and a second end a having a second end shape dissimilar from the first end shape, wherein the second end shape is obtained by cutting through an expanded portion generated by hydroforming an intermediate portion of an extruded piece that initially has a profile corresponding to the first end shape.

10. The longitudinal piece of claim 7, wherein the second end shape comprises an oval.

11. The longitudinal piece of claim 7, wherein hydroforming the extruded piece comprises pre-stretching the other end having the second end shape.

12. The longitudinal piece of claim 7, wherein the piece is extruded from aluminum or an aluminum alloy.

* * * * *